US011345374B1

(12) United States Patent
Stern et al.

(10) Patent No.: US 11,345,374 B1
(45) Date of Patent: May 31, 2022

(54) LIGHTWEIGHT COUPLER

(71) Applicant: Pennsy Corporation, West Chester, PA (US)

(72) Inventors: Aaron Stern, West Chester, PA (US); Manuel Tavares, Doylestown, PA (US); Zachary Ryan Brook, Leola, PA (US); Michael J. Schmidt, Norristown, PA (US)

(73) Assignee: Pennsy Corporation, West Chester, PA (US)

( * ) Notice: Subject to any disclaimer, the term of this patent is extended or adjusted under 35 U.S.C. 154(b) by 294 days.

(21) Appl. No.: 16/378,482

(22) Filed: Apr. 8, 2019

Related U.S. Application Data

(63) Continuation-in-part of application No. 14/930,145, filed on Nov. 2, 2015, now Pat. No. 10,252,733, (Continued)

(51) Int. Cl.
*B61G 3/04* (2006.01)
*B61G 7/00* (2006.01)
(Continued)

(52) U.S. Cl.
CPC ..... *B61G 7/00* (2013.01); *B61G 3/04* (2013.01); *C22C 38/002* (2013.01);
(Continued)

(58) Field of Classification Search
CPC ..... B61F 5/52; B61F 5/00; B61F 5/50; B61G 7/00; B61G 3/04; C22C 38/02;
(Continued)

(56) References Cited

U.S. PATENT DOCUMENTS 461,312 A 10/1891 Brown
533,985 A 2/1895 Brown
(Continued)

FOREIGN PATENT DOCUMENTS

EP 0232042 8/1987
EP 1060971 A1 12/2000
WO 2006072663 A2 7/2006

OTHER PUBLICATIONS

Brandenberg, Kristin, "Successfully Machining Austempered Ductile Iron (ADI)", Applied Process Inc. Technologies Div.—Livonia, Michigan, USA, Oct. 2001.
(Continued)

*Primary Examiner* — Mark T Le
(74) *Attorney, Agent, or Firm* — Bonini IP Law, LLC; Frank J. Bonini, Jr.

(57) ABSTRACT

The coupler system of a railway car truck is constructed such that basic overall appearance may be maintained, but the actual material of which it is constructed is changed. According to one embodiment, the coupler is constructed from cast austempered ductile iron; whereas cast iron has a density, 0.26 lbs/in^3, which is approximately 8% less than steel, 0.283 lbs/in^3, thereby allowing for a reduction in weight over steel. A suitable austempering process is used to produce the austempered metal coupler and components thereof. A second benefit of embodiments of the present invention provides for a more efficient use of materials, meaning less metal is used to make the same final shape, as a way of reducing the coupler weight. Both factures combined allow for a lighter weight coupler, while utilizing the standard designs. Alternate coupler configurations are disclosed for further reducing coupler weight.

25 Claims, 4 Drawing Sheets

Related U.S. Application Data which is a continuation-in-part of application No. 13/678,087, filed on Nov. 15, 2012, now abandoned.

(51) Int. Cl.

| | |
|---|---|
| ***C22C 38/60*** | (2006.01) |
| ***C22C 38/56*** | (2006.01) |
| ***C22C 38/54*** | (2006.01) |
| ***C22C 38/04*** | (2006.01) |
| ***C22C 38/00*** | (2006.01) |
| ***C22C 38/02*** | (2006.01) |
| ***C22C 38/44*** | (2006.01) |
| ***C22C 38/50*** | (2006.01) |
| ***C22C 38/46*** | (2006.01) |
| ***C22C 38/06*** | (2006.01) |
| ***C22C 38/42*** | (2006.01) |

(52) U.S. Cl.

CPC ..... *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/50* (2013.01); *C22C 38/54* (2013.01); *C22C 38/56* (2013.01); *C22C 38/60* (2013.01)

(58) Field of Classification Search

CPC ..... C22C 37/08; C22C 37/10; C22C 38/06; C22C 38/54; C22C 38/60; C22C 38/46; C22C 38/04; C22C 38/008; C22C 38/50; C22C 38/44; C22C 38/42; C22C 38/56; C22C 38/002; C21D 5/00; C21D 9/00

See application file for complete search history.

(56) References Cited

U.S. PATENT DOCUMENTS

| | | | | |
|---|---|---|---|---|
| 559,005 | A | 4/1896 | Timms | |
| 640,147 | A | 12/1899 | McKeen | |
| 693,998 | A | 2/1902 | Brown | |
| 775,902 | A * | 11/1904 | Hien | B61G 3/04 213/109 |
| 1,382,530 | A | 6/1921 | Murphy | |
| 1,966,765 | A | 7/1931 | Murphy | |
| 1,482,751 | A | 2/1934 | Kinne | |
| 2,088,135 | A | 10/1934 | Johnson et al. | |
| 2,186,008 | A | 1/1940 | Everett | |
| 2,562,504 | A | 7/1951 | Metzger | |
| 2,689,051 | A | 9/1954 | Kayler | |
| 2,930,329 | A | 3/1960 | Busch | |
| 3,000,330 | A | 9/1961 | Shafer | |
| 3,604,569 | A | 9/1971 | Kulieke | |
| 3,635,356 | A | 1/1972 | Shramovich | |
| 3,640,402 | A | 2/1972 | Altherr et al. | |
| 3,670,901 | A | 6/1972 | Metzger | |
| 3,722,708 | A | 3/1973 | Ion et al. | |
| 3,735,877 | A | 5/1973 | Bossong | |
| 3,754,514 | A | 8/1973 | Peterson | |
| 3,779,397 | A | 12/1973 | De Penti | |
| 3,854,599 | A | 12/1974 | Day et al. | |
| 3,856,156 | A | 12/1974 | Metzger | |
| 3,858,729 | A | 1/1975 | Altherr | |
| 4,051,954 | A | 10/1977 | Roberts | |
| 4,081,082 | A | 3/1978 | Scherrer et al. | |
| 4,090,615 | A | 5/1978 | Martin | |
| 4,424,750 | A | 1/1984 | Tilly et al. | |
| 4,591,059 | A | 5/1986 | Hammarlund | |
| 4,737,199 | A | 4/1988 | Kovacs | |
| 4,984,696 | A | 1/1991 | Altherr | |
| 5,320,229 | A | 6/1994 | Mautino | |
| 5,410,968 | A | 5/1995 | Hawthorne et al. | |
| 5,481,986 | A | 1/1996 | Spencer et al. | |
| 5,511,676 | A | 4/1996 | Homes | |
| 5,522,949 | A * | 6/1996 | Widmer | C21D 1/20 148/321 |
| 5,878,897 | A | 3/1999 | Lazzaro et al. | |
| 5,900,082 | A | 5/1999 | Hewitt | |
| 5,954,212 | A | 9/1999 | Beatty et al. | |
| 6,102,983 | A * | 8/2000 | Skaland | C21C 1/10 75/568 |
| 6,129,227 | A | 10/2000 | Openchowski et al. | |
| 6,148,733 | A | 11/2000 | Gagliardino | |
| 6,155,442 | A | 12/2000 | Wurzer et al. | |
| 6,173,655 | B1 | 1/2001 | Hawthorne | |
| 6,796,448 | B1 * | 9/2004 | Wilt | B61G 7/10 213/40 R |
| 7,302,994 | B2 | 12/2007 | Mautino et al. | |
| 7,337,826 | B2 | 3/2008 | Mautino et al. | |
| 7,757,871 | B2 | 7/2010 | Mautino et al. | |
| 8,056,741 | B2 | 11/2011 | Mautino et al. | |
| 8,196,762 | B2 | 6/2012 | Smerecky | |
| 8,201,613 | B2 | 6/2012 | Marchese et al. | |
| 8,220,175 | B2 | 7/2012 | Saeler | |
| 8,297,455 | B2 | 10/2012 | Smyth | |
| 8,381,923 | B2 | 2/2013 | Smyth | |
| 8,408,406 | B2 | 4/2013 | Smerecky et al. | |
| 8,485,371 | B2 | 7/2013 | Nibouar et al. | |
| 8,499,819 | B2 | 8/2013 | Nibouar et al. | |
| 8,544,662 | B2 | 10/2013 | Smerecky et al. | |
| 8,631,952 | B2 | 1/2014 | Smerecky | |
| 8,646,631 | B2 | 2/2014 | Marchese et al. | |
| 8,662,327 | B2 | 3/2014 | Nibouar et al. | |
| 9,038,836 | B1 * | 5/2015 | Tavares | B61G 3/04 213/154 |
| 9,452,764 | B2 * | 9/2016 | Stern | B22C 9/046 |
| 9,822,433 | B2 * | 11/2017 | Mito | C22C 33/08 |
| 10,150,490 | B2 * | 12/2018 | Stern | B22C 9/103 |
| 2004/0173555 | A1 | 9/2004 | Wilt et al. | |
| 2005/0093364 | A1 | 5/2005 | Li et al. | |
| 2008/0128377 | A1 | 6/2008 | Mautino et al. | |
| 2009/0289022 | A1 | 11/2009 | Smerecky et al. | |
| 2009/0289024 | A1 | 11/2009 | Nibouar et al. | |
| 2010/0294452 | A1 | 11/2010 | Berthelet | |
| 2010/0326943 | A1 | 12/2010 | Mautino et al. | |
| 2011/0024379 | A1 | 2/2011 | Ely | |
| 2011/0163059 | A1 | 7/2011 | Gagliardino et al. | |
| 2011/0168655 | A1 | 7/2011 | Nibouar et al. | |
| 2012/0248053 | A1 | 10/2012 | Mcmillen et al. | |
| 2012/0292279 | A1 | 11/2012 | Wilt et al. | |
| 2013/0042785 | A1 | 2/2013 | Schmidt et al. | |
| 2013/0160962 | A1 | 6/2013 | Nibouar et al. | |
| 2013/0206716 | A1 | 8/2013 | Burgoyne et al. | |
| 2014/0076193 | A1 | 3/2014 | Brook et al. | |
| 2014/0262107 | A1 | 9/2014 | Hanrahan et al. | |
| 2016/0138139 | A1 * | 5/2016 | Fujimoto | C22C 38/005 75/342 |

OTHER PUBLICATIONS

A. Kahn and B.K. Chen, "Evaluation of Grade 1 Austempered Ductile Iron for Application to Rail Cast Components", Proceedings of the Fifth Asia Pacific Industrial Engineering a.

Luís Magalhães, Jorge Seabra, "Teeth Surface Failures in Austempered Ductile Iron (ADI) Gears", Gears and Transmission Workshop, Paper No. XIII, p. 269-286, Faculdade de Engen.

Stokes B. et al., "Effects of Carbides on Fatigue Characteristics of Austempered Ductile Iron", Metallurgical and Materials Transactions A, 36 (2005) 977-988.

Bubenko et al., "Fatigue Crack Propagation through Austempered Ductile Iron Microstructure", Materials Engineering, vol. 17, 2010, No. 3, p. 15-20.

Bubenko et al.."Fatigue Crack Propagation Within the Austempered Ductile Iron Microstructure", Acta Metallurgica Slovaca, vol. 17, 2011, No. 1, p. 18-25.

Dundar, Sacit, "Application of Austempered Ductile Iron to Rail Wheel Sets", Journal of Engineering Sciences 2003, 9 (3), p. 283-287.

International ADI and Simulation Conference, May 28-30, 1997.

Knuckles, Types E and F—Fatigue Test, AAR Manual of Standards and Recommended Practices Castings, 2009, [M-216] 1-2.

(56) References Cited

OTHER PUBLICATIONS

Keough J. R., et al.,"Continuing Developments in the Science and Application of Austempered Ductile Iron (ADI)", 2012.
AAR Manual of Standards and Recommended Practices Casting Details, Castings, Steel, Specification M-201, S[M-201] 41—S [M-201] 49.
AAR Manual of Standards and Recommended Practices Casting Details, S [M-211] 143—S [M-211] 149.
AAR Manual of Standards and Recommended Practices Casting Details, Coupling Systems, Specification M-215, S [M-215] 337—S [M-215] 342.
"The Six Standard ADI Grades Per ASTM A897/A897M-06", www.appliedprocess.com, Issued Nov. 4, 2008.
AAR Manual of Standards and Recommended Practices Casting Details,Truck Bolsters, Cast or Structural—Design and Testing, Specification M-202, S [M-202] 51—S [M-202] 64.
AAR Manual of Standards and Recommended Practices Casting Details, Truck Side Frames, Cast Steel—Design and Testing, Specification M-203, S [M-203] 65—S [M-203] 76.
AAR Manual of Standards and Recommended Practices Casting Details, Bolster Design Loads, Specification M-203A, S [M-203A] 77—S [M-203A] 82.
AAR Manual of Standards and Recommended Practices Trucks and Truck Details, Truck Performance for Rail Cars, Specification M-976, D [M-976] 31—D [M-976] 38.
"Ductile iron", Wikipedia, the free encyclopedia, http://en.wikipedia.org/wiki/Ductile_iron#Composition, p. 1-3.
Hayrynen, Kathy L., The Production of Austempered Ductile Iron (ADI), 2002 World Conference on ADI.
Aristizabal, Ricardo E., "Intercritical Heat Treatments in Ductile Iron and Steel", Materials Science and Engineering, Birmingham, Alabama, 2012.
FerroPem—Groupe—FerroAtlántica, Newsletter—Jan. 2012.
SAIfoundry, "Austempered ductile iron production properties", http://www.slideshare.net/SAIFoundry/austempered-ductile-iron-production-properties-applications#,Mar. 19, 2012.

* cited by examiner

LIGHTWEIGHT COUPLER

CROSS-REFERENCE TO RELATED APPLICATIONS

This application is a continuation-in-part of, and claims priority to, U.S. patent application Ser. No. 14/930,145, filed on Nov. 2, 2015, which claims priority to U.S. patent application Ser. No. 13/678,087, filed on Nov. 15, 2012, now abandoned, the complete contents of which applications are herein incorporated by reference.

BACKGROUND OF THE INVENTION

1. Field of the Invention

This invention relates in general to railcars and, more particularly, to a railcar coupler, system and method.

2. Brief Description of the Related Art

Railcar couplers are disposed at each end of a railway car to enable joining one end of such railway car to an adjacently disposed end of another railway car. The engageable portions of each of these couplers are known in the railway art as a knuckle. For example, railway freight car coupler knuckles are taught in U.S. Pat. Nos. 4,024,958; 4,206,849; 4,605,133; and 5,582,307.

Typically, adjacent railway cars are joined by heavy shafts extending from each car, known as couplers, and, generally, each coupler is engaged with a yoke housing a shock-absorbing element referred to as the draft gear. The type-E coupler is the standard coupler for railway freight cars. The type-E coupler has standard specifications such that producers making a type-E coupler adhere to a standard specification, so that the standard railway car couplers are completely interchangeable, regardless of the manufacturer. In addition, adherence to a standard also enables couplers from any one manufacturer to be able to be readily joined to couplers from any other domestic manufacturer. The Association of American Railroads ("AAR") has adopted standards for railway couplers. The coupler must include specific geometry and dimensions that allow it to receive a knuckle, and the geometry must be such that the knuckle is allowed to freely operate when coupling and uncoupling railway cars. These dimensions and features of the coupler may be checked for compliance with AAR standards by using gauges, which are applied to the coupler to verify the coupler dimensions or parameters are within an allowable variation or tolerance range.

Couplers have a particular life, and in instances may fail. In many cases when a railcar coupler fails, a replacement coupler must be carried from the locomotive at least some of the length of the train, which may be up to 25, 50 or even 100 railroad cars in length. The repair of a failed coupler can be labor intensive, can sometimes take place in very inclement weather and can cause train delays.

A need exists for a coupler that is lighter in weight with similar, or improved, strength or fatigue life as prior heavier weight couplers.

SUMMARY OF THE INVENTION

The present invention provides a railcar coupler system and method that substantially eliminates or reduces at least some of the disadvantages and problems associated with previous systems and methods.

In accordance with a particular embodiment, a railcar coupler includes a coupler head portion extending from a shank portion. The coupler head portion is configured to couple to a first coupler knuckle for coupling the railcar coupler to a second railcar coupler of an adjacent railcar. The coupler head portion comprises a nose portion and a gathering face extending from the nose portion for engaging a second coupler knuckle coupled to the second railcar coupler. The coupler head portion comprises a guard arm portion extending from the nose portion.

According to some preferred embodiments, the guard arm portion is cast with the head or head portion. According to alternate embodiments, the guard arm portion may be coupled to the coupler head portion after casting the coupler head portion. According to another alternate embodiment, the guard arm portion may be cast with no internal cavities.

In accordance with another embodiment, a method for manufacturing a railcar coupler includes casting a coupler head portion extending from a shank portion. The coupler head portion is configured to couple to a first coupler knuckle for coupling the railcar coupler to a second railcar coupler of an adjacent railcar. The coupler head portion includes a nose portion and a gathering face extending from the nose portion for engaging a second coupler knuckle coupled to the second railcar coupler. According to one embodiment of the method, the method includes casting the guard arm portion as part of the head or head portion. According to another embodiment, the method includes casting a guard arm portion separate from the head portion and coupling the guard arm portion to the coupler head portion such that the guard arm portion extends from the nose portion towards the shank portion. Casting a guard arm portion may comprise casting a guard arm portion with or without internal cavities.

According to a preferred embodiment, a lightweight coupler is provided which is constructed from a material that is stronger than grade E cast steel. Is a further object to accomplish the above objects by providing a coupler that is constructed from a material that is at least as strong or even stronger, than grade E cast steel but which is lighter in weight than grade E cast steel.

It is another object of the invention to accomplish the above objects by providing a coupler with an interior and/or exterior geometry that has one or more of coring and ribs, or combinations thereof so maximum wall thickness is preferably less than about 1.6" and more preferably less than about 1.15" and that also is constructed from a material that is lighter and of similar, or greater, strength than grade E cast steel.

Another object of the invention is to provide a lightweight coupler where the wall thickness, at the thickest section of the wall, is about 2.25".

Another object of the invention is to provide a lightweight coupler where the wall thickness, at the thickest section of the wall, is about 2.00".

Another object of the invention is to provide a lightweight coupler where the wall thickness, at the thickest section of the wall, is about 1.75".

It is an object of the invention to provide a coupler that is constructed from an austempered ductile metal. In a preferred embodiment, the austempered metal is austempered ductile iron (ADI). In another preferred embodiment the austempered metal is austempered steel, such as austempered alloy steel, and, according to other embodiments the coupler may be constructed from an austempered metal alloy.

Austempered ductile iron (ADI) is produced by a suitable austempering process. For example, austempering of ductile iron may be accomplished by heat-treating cast ductile iron to which specific amounts of nickel, molybdenum, manganese or copper, or combinations thereof have been added to improve hardenability; the quantities of the elements needed to produce the ADI from ductile iron are related to the coupler configurations and, for example, may depend on the thickest cross-sectional area of the coupler. Austempered steel and other austempered metals and austempered metal alloys, may be produced by any suitable austempering process.

According to one embodiment, it is another object of the invention to provide an improved lightweight coupler that is of lighter weight than existing current couplers, but without additional coring or modifications to the interior coupler geometry, by constructing a coupler from an ADI having a specific gravity of about 0.26 lbs/in^3, which is less than that of grade E cast steel, 0.283 lbs/in^3. According to one embodiment, a casting of the same shape will be lighter and stronger when constructed from ADI versus grade E cast steel. According to a preferred embodiment, there is a weight reduction of about 8% using the ADI as the preferred material for the coupler versus using grade E cast steel.

Another benefit of the present invention is to provide a coupler and process for producing a coupler that provides economic benefits of conservation of materials, without sacrificing strength. For example, the utilization of a preferred ADI material improves handling efficiencies (as iron is easier to pour than steel), and improves material usage, as the ADI material increases in volume, slightly, as the metal knuckle casting cools compared to steel which shrinks. Accordingly, embodiments of the present invention provide a more efficient use of the materials, meaning less metal may be used to make the same final shape (for a coupler having substantially the same or greater strength as if a greater amount of metal were used), as a way of reducing the coupler weight.

In another preferred embodiment, the austempered metal is austempered steel. Austempered steel is produced by a suitable austempering process. For example, austempering of steel may be accomplished by heat-treating cast steel to which specific amounts of chromium, magnesium, manganese, nickel, molybdenum, or copper, or combinations thereof have been added to improve hardenability; the quantities of the elements needed to produce the austempered steel from the cast alloy steel are related to the knuckle configurations and, for example, may depend on the thickest cross-sectional area of the coupler.

According to another embodiment, a lighter weight coupler is constructed by selectively coring out material in thick load bearing areas to provide an alternate interior and/or exterior geometry for the coupler so maximum wall thickness is preferably less than about 1.0" and more preferably less than about 0.65". Still for other alternate embodiments, the lightweight coupler may be constructed having a maximum wall thickness of up to about 2.25", and, preferably a maximum wall thickness of up to about 2.0", and more preferably, according to another preferred embodiment, the lightweight coupler may have a maximum wall thickness of up to about 1.75". The wall thicknesses are significantly less than the wall thicknesses of prior art couplers, which have maximum wall thicknesses of about 4 inches.

According to preferred embodiments, the coupler may be reduced in thickness in a given zone or area, such as a wall, or a guard arm portion, and the strength to weight ratio may remain the same as or greater than prior couplers having thicker walls, and even being heavier in weight. Preferably wall thickness is less than about 1.0" and more preferably less than about 0.65". According to other preferred embodiments, the lightweight coupler is constructed having wall thicknesses equal to or less than about 2.25", and, according to a preferred embodiment, the wall thicknesses is about 1.75" or less. These maximum wall thicknesses, according to preferred embodiments, define walls of the coupler, including, the coupler shank portion and head portion, which may include the coupler nose portion and the gathering face.

The present coupler also may improve payload to weight ratios, as a lightweight coupler may allow for more weight to be cargo or other payload, especially where a locomotive is pulling a great number of cars that have lightweight couplers.

According to some preferred embodiments, the weight reduction may be made at the back, shank end section of the coupler, and may be accomplished with coring, such as, for example, exterior coring. Embodiments may be produced with reduced weight by providing exterior coring on the side and back sections of the shank.

According to embodiments, the coupler may have one or more zones of coring and ribs, or apertures, bores and/or divots, where the coupler has areas or walls of a maximum cross-sectional thickness and other areas that are less than the maximum cross-sectional thickness.

The arrangement of coring, ribs and wall thickness, may be provided to produce a coupler that is lighter in weight, but possesses sufficient strength, including meeting or exceeding railroad standards, such as AAR standards for couplers. In addition, the coupler embodiments may be produced from an austempered metal, such as, for example, austempered ductile iron, which is lighter in weight than grade E cast steel, but provides equal or greater strength, to provide a lightweight coupler that is constructed from ADI and has an arrangement of ribs and/or coring.

According to another embodiment, a coupler is provided having one or more zones of residual compressive stresses. According to one embodiment, a zone, or zones, of residual compressive stresses may be created on the entire inside and outside surface of any of the above embodiments of the lightweight coupler, while according to alternate embodiments, zones of residual compressive stresses may be created only in areas that show high tensile stress when the part is used, or combinations thereof in the areas that show high tensile stresses. For example, according to a preferred embodiment, a coupler is provided with zones of residual compressive stresses in the main areas that exhibit high tensile stress during use, which preferably include the front face or throat area, the guide or guard arm and the shank hole. According to one embodiment, a preferred method for creating residual compressive stresses is by shot peening. Shot peening involves impacting the surface with small spherical media projected at high speeds at the desired surfaces. According to embodiments of the invention, an engineered surface is provided, such as, for example, by subjecting the surface to a treatment process, such as, for example, shot peening, in order to provide the coupler with an improved ability to counteract tensile stresses that are applied during use that may otherwise tend to cause crack initiation. The provisioning of the residual compressive stresses on the coupler, such as, for example, using the shot peening procedure to impart impacts on the surfaces of the coupler at one or more desired locations, increases fatigue life and performance without the need to increase the overall strength of materials or of the part.

The lightweight couplers according to the invention may be used with standard knuckles or lightweight knuckles, including, such as, for example, the lightweight knuckles disclosed in our co-pending U.S. patent application Ser. No. 13/678,021 filed on Nov. 15, 2012, for a lightweight fatigue resistant knuckle, the contents of which are herein incorporated by reference.

Other technical advantages will be readily apparent to one skilled in the art from the following figures, descriptions and claims. Moreover, while specific advantages have been enumerated above, various embodiments may include all, some or none of the enumerated advantages.

DETAILED DESCRIPTION OF THE INVENTION

The present invention provides an improved coupler which has improved strength and fatigue life. One way in which embodiments of the invention accomplish this is by providing coring that may include interior coring, external coring, or both. Another way in which embodiments of the invention accomplish this is by providing a material that is stronger than the grade E cast steel currently used. A further way in which embodiments of the invention accomplish this is by utilizing a material to construct the coupler that is stronger and lighter than the grade E cast steel currently used, while other embodiments provide a lightweight coupler by providing a unique geometry and using a material that is lighter than the current cast steel and/or stronger than the current cast steel. The embodiments also may include ribs provided for strengthening areas or zones of the coupler, which, according to preferred embodiments, may be done in conjunction with coring.

Figure 1:
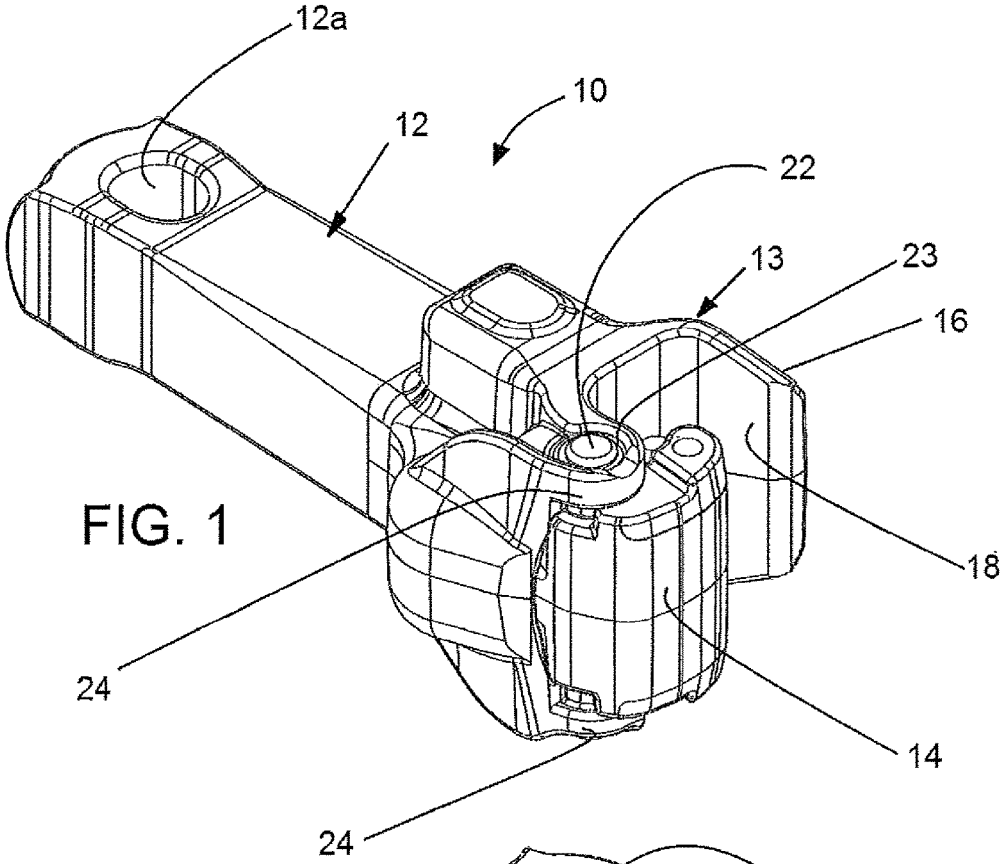
FIG. 1 is an isometric view of a railcar coupler according to the present invention.
Figure 2:
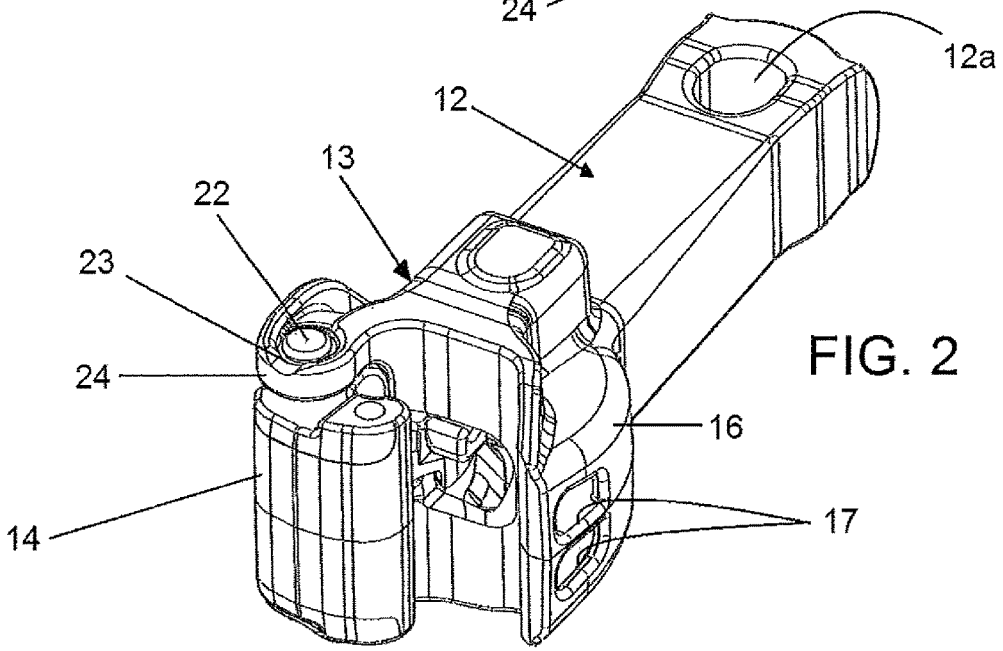
FIG. 2 is another isometric view of the railcar coupler of FIG. 1, as viewed from the right side.
Figure 3:
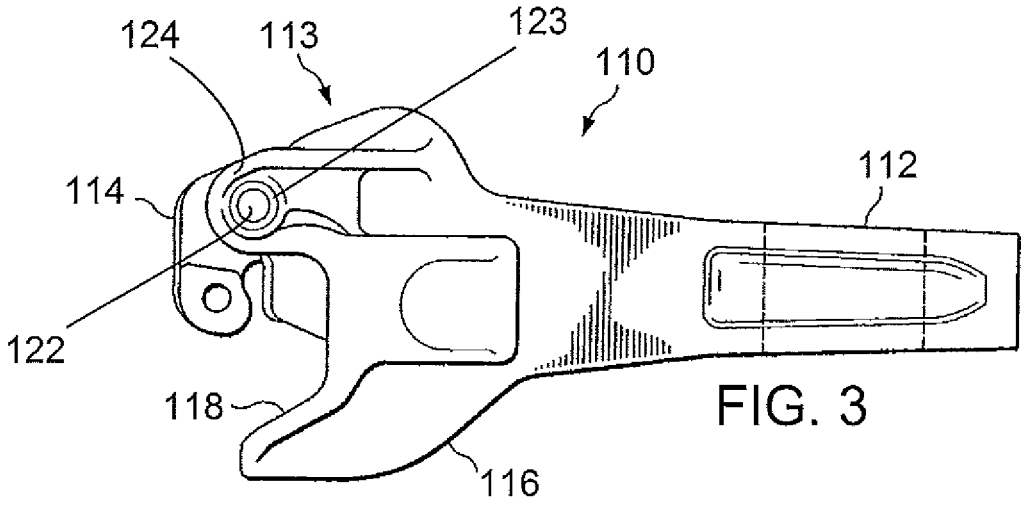
FIG. 3 is a top plan view of an alternate embodiment of a railcar coupler according to the present invention.
Figure 4:
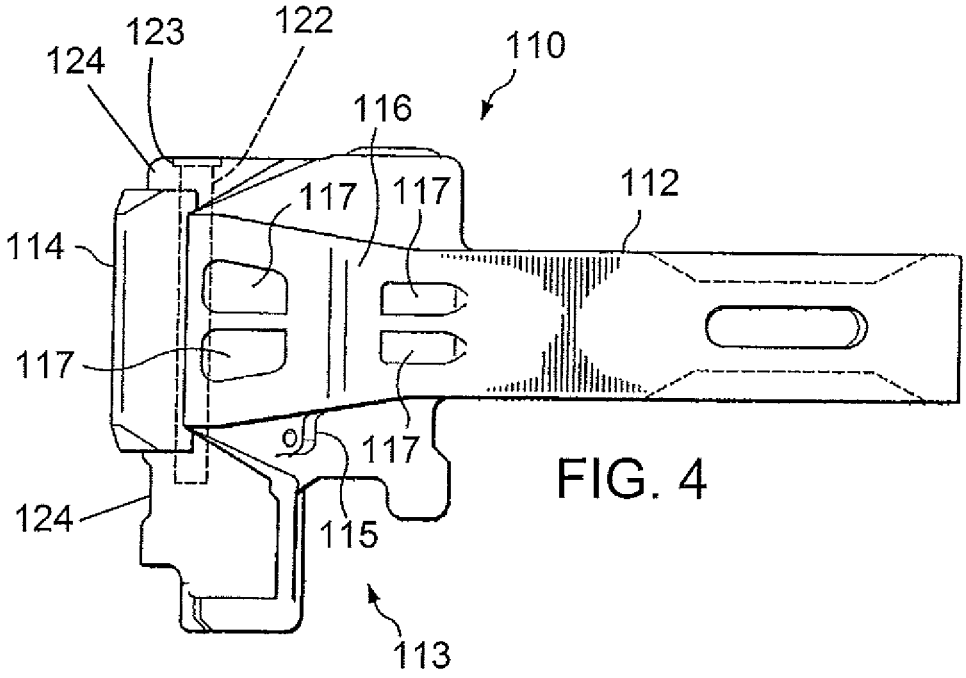
FIG. 4 is a right side elevation view of the railcar coupler of FIG. 3.
Figure 5:
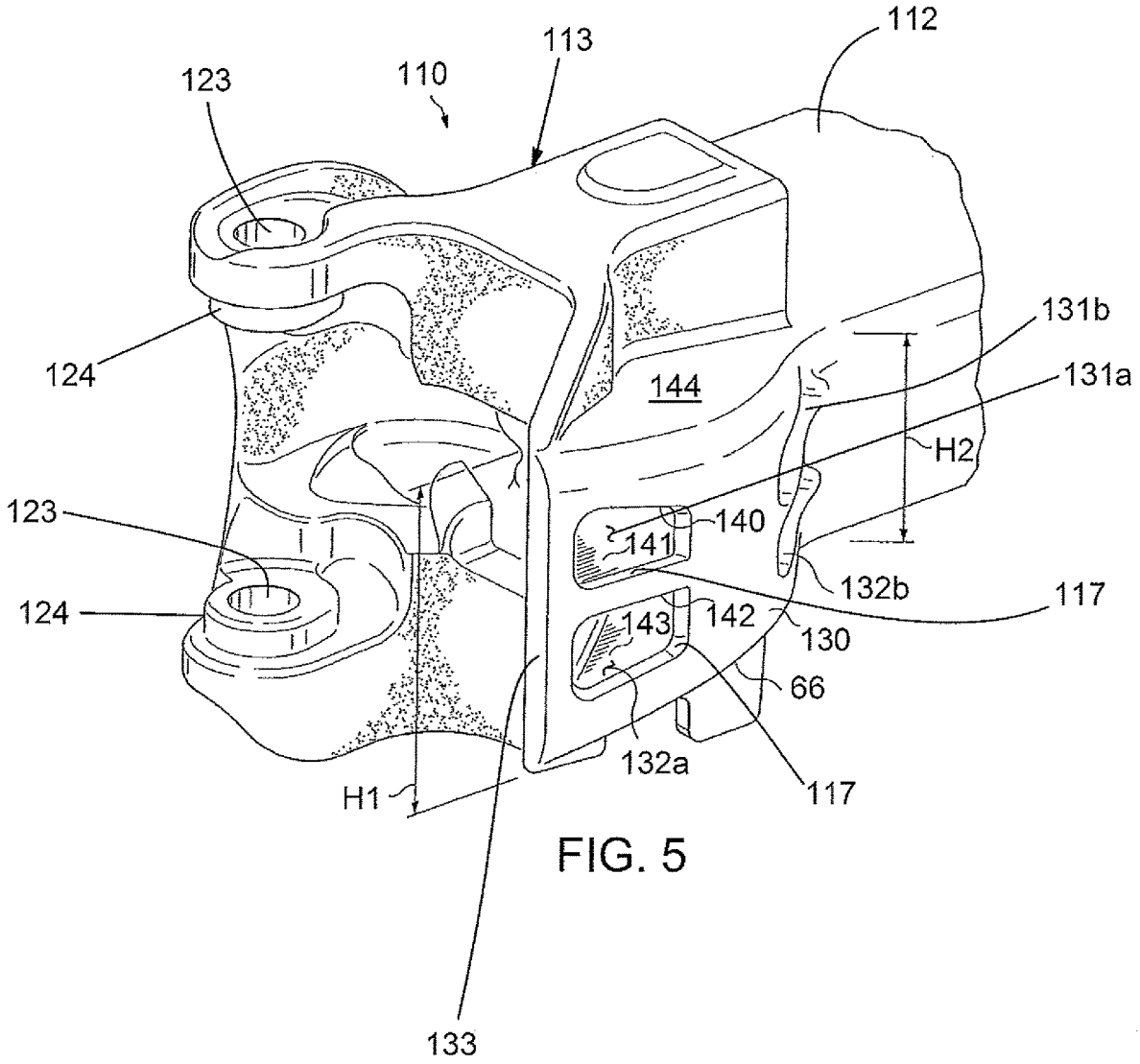
FIG. 5 is an isometric view of the railcar coupler of FIG. 3.

According to the embodiments illustrated, the coupler 10 shown in FIGS. 1-2, and the coupler 110 shown in FIGS. 3-5, may be constructed having a suitable wall thicknesses to provide the coupler with suitable strength to withstand force loads that the coupler encounters during operations, including when in use on a railway vehicle. The coupler, also referred to as a railway vehicle coupler, may be configured as a casting that includes a coupler housing and a shank which is adapted to be mounted in a draft gear (not shown) on the end of a center sill of a railway vehicle. The coupler carries a pivotally connected knuckle that is movable between open and closed positions. According to preferred embodiments, the coupler shank and housing casting, as well as the knuckle casting, may be made from an austempered metal, and preferably austempered steel, such as, austempered alloy steel. Other austempered metals, such as, for example, austempered ductile iron, and austempered metal alloys, may be used to construct the coupler.

According to a preferred embodiment, the unique geometry includes providing one or more zones of reduced material, which, for example, according to one embodiment, may be accomplished by coring, and preferably, with specialized coring in designated zones of the coupler, which, for example, may be provided in the housing, the shank, the knuckle component, or any one or more or all of these. Embodiments of the coupler also may include ribs provided for strengthening areas or zones of the coupler, which, according to preferred embodiments, may be done in conjunction with coring. The ribs may be provided in configurations alternate to those shown and described herein. Although embodiments of the present lightweight coupler may be constructed to resemble prior coupler geometries, including prior exterior coupler geometries, lightweight couplers according to the invention may be constructed to have geometries that are different than prior couplers, but which also are compatible with coupling and usage of the prior couplers, so that the current coupler may provide a lightweight coupler alternative that may be used in place of prior couplers, wherever the prior couplers have been used or are called for.

According to preferred embodiments of the invention, a coupler configuration is provided having areas of the coupler that are reduced relative to other areas of the coupler (which may be areas and other areas within the same coupler component, e.g., the housing, shank and knuckle. The preferred geometries of the coupler provide zones of size or weight reductions or both size and weight reduction, and where the size or weight reductions, or both, are employed to maximize the strength of the coupler. According to a preferred embodiment, a coupler is provided with reduced areas of size or weight, or, in some instances, elimination of structure in certain areas to provide a suitably strong coupler that is able to withstand the stresses required for performance under operating loads.

According to a preferred embodiment, a lightweight coupler may be substantially the same in appearance on the exterior to prior coupler exterior appearances, yet the lightweight coupler may have a unique coring which is designed to provide adequate strength yet eliminate extraneous material. For example, the operative contour of the coupler that is exhibited on the coupler exterior, such as, for example, the engaging surfaces, may have an appearance similar to prior couplers, but unlike prior couplers, be configured with a different interior construction, where the interior geometry of the coupler is configured and arranged in a manner that provides suitable performance strength with a reduced construction weight.

FIGS. 1 and 2 illustrate a coupler 10 for freight railway cars in accordance with standard specifications as set forth by the Mechanical Committee of Standard Coupler Manufacturers. Coupler 10 is mounted within a yoke (not shown) secured at each end of a railway car center sill, such that, in accordance with a preferred mounting arrangement, the coupler 10 may extend outwardly under an end of a railway car to engage a similar coupler (or any compatibly connectible coupler) extending outwardly under an end of an adjacent railway car. Coupler 10 includes a shank 12 having a bore 12*a* which is adapted to connect to the yoke (not shown) on the end of a center sill of a railway vehicle. The generally V-shaped coupler head 13 is provided at a forward end extending from the shank 12. Shank 12 is adapted to be fitted within and attached to a yoke secured at each end of a center sill extending full length under the railway car at a longitudinal axis.

Coupler head 13 has a vertical-knuckle 14 rotatably pinned at an outer end of coupler head 13 forming a first leg of coupler head 13, while a second leg of coupler head 13 comprises a fixed and rigid guard arm portion 16 with cavities 17. Coupler 10 also includes a first angled gathering surface 18 (FIG. 1) against which a vertical-knuckle 14 on a mating coupler similar to coupler 10 is intended to impact when two adjacent railway cars are brought together. When vertical knuckle 14 impacts against an angled gathering face 18 of another coupler, it and the opposing vertical knuckle 14 are each pivoted inwardly to a degree sufficient to lock them in place behind each other so that the couplers 10 are properly joined together. A lock member slidably disposed within each coupler head 13 may be activated by the engagement to slide downwardly within the coupler head 13 and lock the vertical knuckle 14 in place to thereby join the two railway cars together. Coupler 10 is illustrated additionally including a chain lug (not shown) which preferably is provided at the lower portion of the head 13.

To assure a successful coupling, the two railway cars preferably may be sitting on a straight length of track, and the two couplers, like coupler 10, may be at least generally oriented parallel to the track and perpendicular to the end of the railway car to face each other. In some cases, couplers may include features such as extended guard arm portions, as illustrated in U.S. Pat. No. 6,148,733, that facilitate railway car coupling when the railway cars are sitting on a length of curved track or are otherwise not aligned with each other.

FIG. 3 is a top plan view of a coupler 110 with a shank 112, a head 113, a knuckle 114, a first angles gathering surface 118, a fixed guard arm portion 116. As best shown in FIG. 4, cavities 117 are illustrated provided in the arm 116 and a chain lug 115 also is shown. The chain lug 115 may be used to support hoses (such as air line hoses) and other components when the coupler 10 is not operational or otherwise not connected. Chain lugs in some couplers may be located on a coupler lock chamber. A knuckle pin 122 which is installed in pivot pin openings 123 (only one being illustrated) of pivot lugs 124 retains the knuckle 114 on the head 113. As illustrated in FIG. 5, a preferred configuration of the head 113 of the coupler 110 is illustrated to show an exemplary embodiment where the pivot lugs 124 are aligned with the respective pivot openings 123. The exemplary coupler 110 may be configured having a guard arm portion 130 with cavities 131*a*, 132*a* and 131*b*, 132*b*. The cavities may be defined by interior sidewalls 140, 141, 142, 143. An exterior sidewall 144 is also shown in FIG. 5. The guard arm portion 130 extends from the shank 112 to the nose portion 133 of coupler 110. According to some embodiments, the construction is provided so that the slope and configuration of the guard arm portion 130 provide strength and stability to the coupler 110, and in particular the portion of the coupler 110 extending between the nose portion 133 and the shank 112.

In accordance with prior couplers, cavities 131*a*, 132*a* and 131*b*, 132*b*, have been provided to reduce weight. However, the cavities, while reducing weight, have led to problems in strength. According to a preferred embodiment, the present invention provides a casting of the coupler 110, and more particularly, of the coupler head 113 and shank 112 with an austempered metal to produce a stronger and more fatigue-resistant coupler 110. According to a preferred embodiment, the austempered metal is austempered steel, and according to another embodiment the austempered metal is austempered ductile iron. The austempered ductile iron embodiment provides suitable strength, yet may provide a coupler that is significantly lighter, for example, up to 8% in weight lighter, than couplers that are constructed from cast grade E steel. According to one embodiment, it is another object of the invention to provide an improved fatigue-resistant coupler that is of lighter weight than existing current couplers, but without additional coring or modifications to the interior geometry, by constructing a coupler from an austempered ductile iron (ADI) having a specific gravity of about 0.26 lbs/in^3, which is less than that of grade E cast steel, 0.283 lbs/in^3. According to one embodiment, a casting of the same shape will be lighter and stronger when constructed from ADI versus grade E cast steel. According to a preferred embodiment, there is a weight reduction of about 8% using the ADI as the preferred material for the coupler versus using grade E cast steel.

Coupler 110 having guard arm portion 116, according to a preferred embodiment, may be manufactured through a casting process with a metal, such as ductile iron (DI), steel or alloys of either or other metal alloys and then austempered after casting. Typically one or more cores may be used in the manufacturing process in order to form cavities 131*a*, 131*b*, 132*a*, 132*b*. The cores typically may be made of resin or otherwise hardened sand. Specifically, the coupler 110 may be produced in a mold cavity within a casting box between cope and drag sections. Sand, such as green sand, may be used to define the interior boundary walls of the mold cavity. The mold cavity may be formed using a pattern and may include a gating system for allowing molten metal, which preferably is austempered metal, to enter the mold cavity. The mold cavity defines the exterior surfaces of coupler 110, including the exterior surface of guard arm portion 116. The cores used to form cavities 131*a*, 131*b*, 132*a*, 132*b* are placed at an appropriate location within the mold cavity. Once the coupler 110 is cast, the sand or resin cores may be removed leaving cavities 131*a*, 131*b*, 132*a*, 132*b*. Accordingly, embodiments where cavities other than those illustrated in FIGS. 3-5 are present may be formed in a similar manner, through the use of the aforementioned casting and gating systems. Coupler 110 may undergo a metal finishing process that includes finishing the interior surfaces of cavities 131*a*, 131*b*, 132*a*, 132*b*, including the interior sidewalls 140, 141, 142, 143. Alternatively the casting can be made as an investment casting to ensure tighter tolerances.

Moreover, while particular embodiments are illustrated herein as Type E couplers, other embodiments may include similar features and configurations in other types of couplers, such as Type F or H couplers.

According to an alternate embodiment, the couplers may be cast without the guard arm portions. This may be done a number of ways, including, for example, using a typical casting process with a metal (such as, for example, ductile iron (DI), steel, alloy ductile iron, or alloy steel) and austempered after casting. The head 113 may therefore be cast as a head portion without the guard arm portion 116, and accordingly, the guard arm portion 116 may be coupled to the head portion after casting the coupler head portion. According to some embodiments, the guard arm portion 116 may be cast with internal cavities, and according to other embodiments, the guard arm portion 116 may be cast with no internal cavities. Preferably, the guard arm portion 116 is cast using a typical casting process with a metal (such as, for example, alloyed ductile iron (DI) or alloy steel) and austempered after casting. For example, as discussed above with respect to coupler 110, the coupler head portion may be produced in a mold cavity within a casting box between cope and drag sections. Sand may be used to define the interior boundary walls of the mold cavity. The mold cavity may be formed using a pattern and may include a gating system for allowing molten alloy to enter the mold cavity. The mold cavity defines the exterior surfaces of coupler head portion. Since, as indicated above, the head portion of the coupler 110, according to an alternate casting embodiment, is cast without guard arm portion 116, the mold cavity may have a different configuration than a mold cavity used to produce the coupler 110 when the coupler is produced with the head 113 including the head portion and the guard arm portion 116. For example, the mold cavity used to produce the coupler head portion, where the guard arm portion 116 is separately provided, will not include a cavity section defining guard arm portion 116. According to alternate embodiments where a guard arm portion 116 is not produced with the casting of the head 113, then after the guard arm portion 116 has been produced, it is attached to the head portion that was independently formed without a guard arm portion. Attachment of a guard arm portion to a head portion may be accomplished using any suitable method, such as by welding the guard arm portion to the head portion, bolting, or other fastening mechanism.

According to the alternate embodiments, where the guard arm portion 116 is provided separate from the head portion, the guard arm portion 116 may be independently produced using any suitable method, such as, for example, a casting process similar to that used to produce coupler 10 and 110 (where the guide arm portion 116 is cast with the head 113). In this case, where the guard arm portion 116 is provided as a separate component to the coupler, a mold cavity may be designed to define the outer surfaces of guard arm portion 116. Although guard arm portions are shown and described herein, the guard arm portions, according to alternate embodiments not illustrated, may include shapes and/or configurations different from those guard arm portions 16, 116, and thus mold cavities used to form other guard arm portions may be different from a mold cavity used to form guard arm portions 16, 116. Alternatively the casting can be made as an investment casting to ensure tighter tolerances.

According to some embodiments, the chain lug 115 may be formed through the core process used in the coupler manufacturing process. According to alternate embodiments, while not shown, the chain lug 115 may be cast without its hole, and then the hole may be located using a drill, punch or other method. This permits specific placement of the chain lug hole.

According to alternate embodiments, the chain lug may comprise a hole positioned on the guard arm portion, or alternately, the chain lug may be coupled to the guard arm portion. Preferably, the chain lug may be positioned so it is located near the head of the coupler to provide a good location for support of the hoses and other components (since they may be more fully extended when supported at the chain lug than if the chain lug were positioned further back on the coupler).

Figure 6:
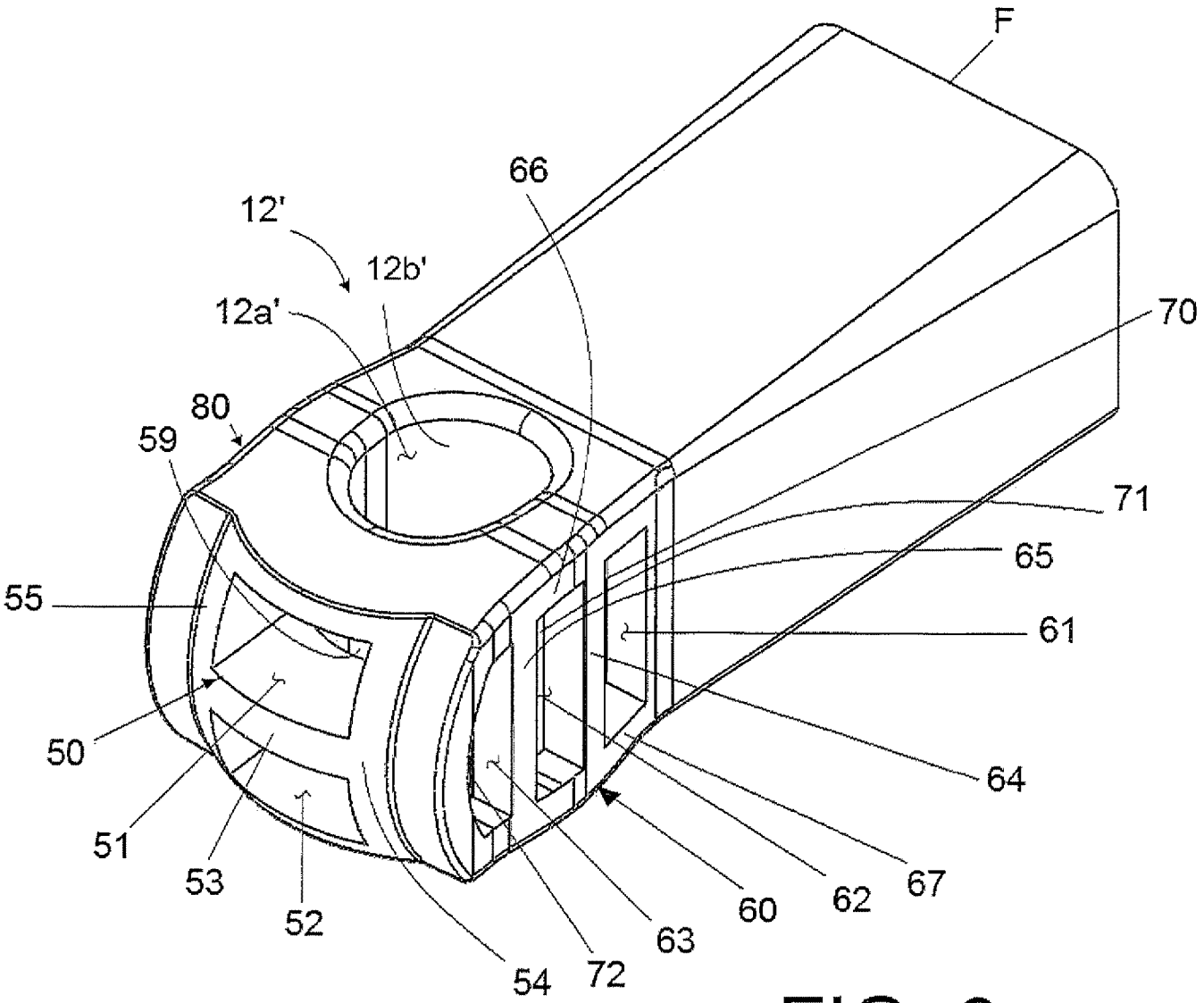
FIG. 6 is an isometric view of an alternate embodiment of a coupler rear section in accordance with the invention, which may be used in the construction of a coupler, including, for example, any of the couplers shown and described herein.

Referring to FIG. 6, an isometric view of a rear section 12' of a coupler is shown in accordance with an alternate embodiment of the invention. The rear section 12' configuration may be applied and used in the construction of couplers, including those couplers shown and described herein. The coupler rear section 12' shows the shank portion of a coupler, the head of which (although not shown in FIG. 6) would be located at the front end denoted by the reference F. The coupler rear section 12' has a bore 12*a*' which is adapted to connect to the yoke (not shown) on the end of a center sill of a railway vehicle. The bore 12*a*' preferably is defined by a wall 12*b*'. According to preferred embodiments, the wall 12*b*' may span from the top of the bore 12*a*' to the bottom of the bore 12*a*', and preferably, the bore 12*a*' extends entirely through the coupler section 12'. A coupler head (not shown in FIG. 6) is provided at the front end F of the coupler rear section 12' to complete the coupler (and a coupler knuckle may be installed on the head). A rear weight reduction zone 50 is provided on the rear of the coupler rear section 12', and, according to a preferred embodiment, is illustrated with coring comprising a first core 51 a second core 52 and a rib 53 spanning between a first side wall 54 and a second side wall 55. The rear weight reduction zone first core 51 and second core 52 may terminate at an inner wall, such as, for example, the inner wall 59 shown at the inner end of the first core 51. The inner wall 59 of the first core 51 may be coextensive with the bore wall 12*b*', and, according to preferred embodiments, inner wall 59 may be the exterior surface of the bore wall 12*b*'. Similarly, although not shown, the second core 52 may have an inner wall that may be coextensive with the bore wall 12*b*', and, according to preferred embodiments, the second core inner wall may be the exterior surface of the bore wall 12*b'*.

The coupler rear section 12' and couplers formed therewith, preferably have a plurality of weight reduction zones. According to a preferred embodiment, a first side weight reduction zone 60 is provided on one side of the coupler rear section 12', and preferably, a second side weight reduction zone 80 (not shown in detail) is provided on the opposite side of the coupler rear section 12'. According to a preferred embodiment, the first side weight reduction zone 60 includes coring. In a preferred arrangement, coring is illustrated comprising a first side core 61, a second side core 62 and a third side core 63. Ribs 64 and 65 are spaced apart to define the side cores, 61, 62, 63, and span between an upper wall portion 66 and a lower wall portion 67. Preferably, side cores, 61, 62, 63, have a depth relative to the outer surface of the coupler rear section 12' that is defined by upstanding side walls, respectively 70, 71, 72. The upstanding side walls 70, 71, 72, according to preferred embodiments, may be formed coextensive with the bore wall 12*b*'. For example, according to a preferred embodiment, the bore wall 12*b*' may have a first side that defines in whole or part the bore 12*a*' and a second side that defines the upstanding side walls 70, 71, 72, and, preferably, the second side may also define the inner wall 59. The rib 53 spanning between the first side wall 54 and a second side wall 55 of the rear weight reduction zone 50 may be joined with the bore wall 12*b*' (e.g., at the inner wall 59).

A second side weight reduction zone 80 (not shown in detail) preferably is provided and may be configured on the side of the coupler rear section 12' that is opposite the side at which the first side weight reduction zone 60 is provided. The second side weight reduction zone 80 preferably has ribs and coring configured in the same manner as the ribs and coring shown and described in connection with the first side weight reduction zone 60.

The coupler rear section 12' may be constructed having a suitable wall thicknesses to provide the coupler section 12' and coupler constructed with the section 12' with suitable strength to withstand force loads that are encountered during operations, including when in use on a railway vehicle. The coupler section 12' and couplers constructed incorporating the section 12' may be configured as a casting. Although the coupler rear section 12' is described and illustrated, a coupler may be constructed having the rear section 12', and preferably is configured with a head portion with suitable connecting means at the front F of the coupler rear section 12', for coupling the coupler to a railcar coupler of an adjacent railcar. The connecting means may comprise a coupler knuckle carried on the front or head portion of the coupler. Preferably, the coupler knuckle carried at the front F of the rear section 12', such as on a head portion connected to the front F of the rear section 12', is configured to couple to a railcar coupler of an adjacent railcar. The coupler including the configuration of the rear section 12' preferably is lighter in weight, yet suitably strong to meet or exceed the AAR standards for railcar couplers.

According to some preferred embodiments, the coupler rear section 12' may be constructed having maximum wall thicknesses of preferably less than about 1.6" and, more preferably less than about 1.15" if ADI is used and preferably less than about 1.0" and, more preferably less than about 0.65" if austempered steel is used. According to a preferred embodiment, the lightweight coupler is constructed from ADI and has a maximum wall thickness of up to about 2.25", and for other preferred embodiments, has a maximum wall thickness of up to about 2.0", and, more preferably, a maximum wall thickness of up to about 1.75".

According to a preferred embodiment, coupler walls are constructed having preferred thickness dimensions. The couplers may be made in accordance with any of the couplers shown herein, such as, for example, couplers 10, 110. According to one preferred embodiment, a railway vehicle coupler is constructed having a shank portion, a coupler head portion comprising a nose portion and a gathering face portion, having a wall thickness of from between about 0.25" and about 3.00", and being made of an austempered metal. In some preferred embodiments, austempered metal may be austempered ductile iron, while in other embodiments, the austempered metal is austempered steel. Preferably, the shank portion, head portion including the nose portion and gathering face portion are formed by walls and these forming walls have wall thicknesses from between about 0.25" and about 3.00". According to one embodiment, a coupler is provided where the walls forming the shank portion and head portion including the nose portion and gathering face portion have a thickness of between about 0.375" and 1.75". According to another embodiment, a coupler is provided where the walls forming the shank portion and head portion including the nose portion and gathering face portion have a maximum wall thickness of about 2.00". According to another embodiment, a coupler is provided where the walls forming the shank portion and head portion including the nose portion and gathering face portion have a maximum wall thickness of about 1.60". According to another embodiment, a coupler is provided where the walls forming the shank portion and head portion including the nose portion and gathering face portion have a maximum wall thickness of about 1.15". According to another embodiment, a coupler is provided where the walls forming the shank portion and head portion including the nose portion and gathering face portion have a maximum wall thickness of about 1.00". According to another embodiment, a coupler is provided where the walls forming the shank portion and head portion including the nose portion and gathering face portion have a maximum wall thickness of about 0.65".

Couplers 10, 110 may be constructed from austempered ductile iron, and according to a preferred embodiment, the coupler is formed from austempered ductile iron having a minimum tensile strength of 130 ksi, a minimum yield strength of 90 ksi, a minimum elongation in 2 inches of 3%, and a BHN within a range of about 302 to about 460.

According to some embodiments, the wall thickness may be the same thickness at the shank portion and coupler head portion (including the nose and guard arm portion) and within the range of 0.25" to about 3.0", while according to other embodiments, the thickness of the walls at each of these locations may be different, but within a range of 0.25" to about 3.0" at each of these locations. Embodiments having different thickness ranges also may have the shank portion and coupler head portion (including the nose and guard arm portion) as the same thickness or different thicknesses.

In accordance with preferred embodiments, the thickness may be measured in accordance with a spherical diameter. For example, according to a preferred embodiment, couplers according to the invention may be constructed with a wall thickness that would permit a sphere of diameter "D" to fit within the volume of the coupler walls. According to one embodiment, the minimum spherical diameter may be as small as 0.25 inches for the diameter "D". According to some embodiments, the maximum equivalent spherical diameter may be up to five times the minimum equivalent spherical diameter, wherein Dmin is the smallest or minimum spherical diameter of a coupler wall, and wherein Dmax is a maximum spherical diameter of a coupler wall, expressed as Dmin< or =5×Dmax. In other words, some coupler walls may be five times as thick as other coupler walls. According to some preferred embodiments, for coupler walls, the range for the sphere diameter for spheres that fit within the volume of a coupler is from about 0.25 to about 3.0 inches. The range of spherical diameters may be 1 to 16, from the smallest spherical diameter to the largest spherical diameter. According to some alternate embodiments, the spherical diameter range may be 1 to 8, or 1 to 6, or 1 to 4. According to further embodiments, the minimum spherical diameter of a wall may be 0.25 inches to 0.75 inches, and may be further defined by a spherical diameter range, such as any of those ranges mentioned herein.

Furthermore, further strengthening of the couplers shown and described herein may be accomplished by providing shot peened surfaces. For example, one or more of the inner surfaces and outer surfaces of the coupler, including the surfaces that define the cavities 131*a*, 131*b*, 132*a*, 132*b*, may be provided with a shot-peened surface. The shot peened surface treatment, for example, may be applied to one or more of the guard arm 16 (FIG. 1), 116 and the gathering surface 18 (FIG. 1), 118. The shot-peened surfaces may include inner surfaces and outer surfaces of the knuckle, and may further include the surfaces of ribs when ribs are present and used in an embodiment. A shot-peened surface treatment preferably is applied to the surfaces to provide added strength. The shot-peened surface treatment may be applied by any number of ways, including, for example, by impacting the surface with shot (e.g., round metallic, glass, or ceramic particles) with force sufficient to create plastic deformation. In addition, the embodiment of the coupler rear portion 12' illustrated in FIG. 6 also may be provided with a shot-peened surface treatment along one or more of its surfaces.

In addition, although cavities 131*a*, 131*b*, 132*a*, 132*b* are shown and described in connection with the guard arm portion 116, the couplers according to the invention, including couplers such as the couplers 10, 110, may have cavities in other locations of the coupler, including, for example, the head and shank. In addition, a knuckle may be provided having cavities. According to a preferred embodiment, the coupler 10, 110, and couplers formed with the coupler rear section 12', may be configured with and include a knuckle constructed according to our copending application U.S. Ser. No. 13/678,021 filed on Nov. 15, 2012, including, for example, lightweight, fatigue resistant knuckles shown and described therein.

For example, according to a preferred embodiment, the couplers according to the invention may be constructed with a wall thickness that would permit a sphere of 0.25 inches to fit within the volume of the coupler walls. According to some embodiments, the maximum equivalent spherical diameter may be up to five times the minimum equivalent spherical diameter. In other words, some coupler walls may be five times as thick as other coupler walls. According to some preferred embodiments, the range for the sphere diameter for spheres that fit within the volume of a coupler is from about 0.25 to about 3.0 inches.

As indicated above, particular embodiments discussed herein include couplers having different configurations, including having guard arm portions of various shapes, sizes and configurations and having various configurations where the chain lugs may be positioned in various places on the coupler. Embodiments of the present invention may combine one or more of the various guard arm portion casting or attachment methods and chain lug features and/or elements discussed herein.

Although the present invention has been described in detail with reference to particular embodiments, it should be understood that various other changes, substitutions, and alterations may be made hereto without departing from the spirit and scope of the present invention. The present invention contemplates great flexibility in the manufacturing process of couplers and coupler knuckles and the shape, configuration and arrangement of one or more internal or external cores used in the manufacturing process.

A significant benefit of the present invention is that current proven coupler design and the composition of forming the coupler (including one or more of the coupler components, such as, the knuckle and coupler and guide arm portion when case separately from the head portion) from an austempered metal, provides a coupler that is stronger and more fatigue-resistant. In addition, the coupler may be constructed using additional coring to provide a coupler that is lighter, but also is stronger and also has improved resistance to fatigue (including when compared with other couplers weighing substantially the same as, or greater than, prior couplers). According to some embodiments, the couplers of the present invention may be constructed from austempered metal to significantly improve the strength. In addition, due to the increased strength of the material, such as, for example, when the coupler is constructed from austempered metal (e.g., such as, for example, austempered ductile iron), coring configurations (including those shown and described herein, as well as alternate coring arrangements) may be used to provide a coupler that may be lighter in weight than prior couplers and which also possesses increased resistance to fatigue (including in comparison to prior couplers that are heavier in weight). The exemplary embodiments shown and described herein illustrate examples of preferred coring for a coupler having improved strength and resistance to fatigue, as well as a coupler that is lighter in weight than traditional prior couplers. Other coupler embodiments disclosed herein provide a coupler configuration that is similar to prior coupler configurations, but is constructed from an austempered metal (preferably austempered steel or austempered ductile iron) to provide an improved strength to weight ratio as well as improved elongation properties. Still other embodiments provide both coring and rib configurations to reduce mass, and compose the coupler from an austempered metal (preferably austempered steel or austempered ductile iron), to improve or maintain the strength of the coupler (e.g., a strength to weight ratio).

According to preferred embodiments of the invention, lightweight couplers may be constructed from grade E stainless steel, such as for example, couplers configured with the coupler rear section 12' where one or more weight reduction zones are provided to reduce the weight of the coupler. According to other preferred embodiments, lightweight couplers, including the couplers 10, 110, and, including, in addition thereto, couplers configured with a construction of weight reduction zones as disclosed in connection with the coupler rear section 12', are constructed from an austempered metal, preferably austempered steel, austempered ductile iron, austempered steel alloy or austempered ductile iron alloy. Preferred compositions, such as steel, as well as alloy steel compositions, e.g., alloyed preferably with magnesium, manganese, molybdenum, copper or mixtures thereof, or more preferably, with chromium, nickel or mixtures thereof, (or mixtures of the preferred and more preferred metals), may be used to form the couplers as discussed and shown herein. The steel or preferred/more preferred alloy steel composition is austempered to obtain tensile strength, yield, and elongation properties for the inventive couplers which are suitable to meet or exceed the AAR standards for couplers, including the current standard set forth by the American Association of Railroads (AAR) in AAR Manual of Standards and Recommended Practices, such as current standard M-211, M-205, M-220 NDT and Rule 88 of the AAR Office Manual, the complete contents of which are herein incorporated by reference. Couplers may be constructed from ductile iron that is austempered. The ductile iron also may be used in alloy form, preferably, with nickel, molybdenum, manganese, copper, or mixtures thereof, to form couplers.

The couplers may be constructed in accordance with a suitable forming method, such as, for example, a casting method, used to produce a coupler that meets or exceeds the AAR coupler standards.

Lightweight couplers may be produced using the improved coupler configurations disclosed and shown herein. In addition, lightweight couplers are constructed from austempered ductile iron, austempered ductile iron alloy, austempered steel, and/or austempered steel alloy, in accordance with the invention, to provide couplers that are lighter in weight than prior couplers yet possesses suitable strength, yield and fatigue resistant properties that meet or exceed AAR testing and standards requirements set forth by the American Association of Railroads (AAR) in AAR Manual of Standards and Recommended Practices, and in Rules of the AAR Office Manual, the compete contents of which are herein incorporated by reference.

According to preferred embodiments, couplers are constructed from austempered ductile iron, and according to a preferred embodiment, they are formed from austempered ductile iron having a minimum tensile strength of 130 ksi, a minimum yield strength of 90 ksi, and a minimum elongation in 2 inches of 2%. Additionally, some preferred embodiments have a BHN (Brinell hardness number) within a range of about 302 to about 460. According to some more preferred embodiments, couplers are formed from austempered ductile iron having a minimum tensile strength of 190 ksi, a minimum yield strength of 160 ksi, and a minimum elongation in 2 inches of 7%. The couplers also may have a BHN within a range of about 302 to about 460. According to a preferred embodiment, the ADI is a 190/160/7 in a standard 1" Y-block. In accordance with preferred embodiments, the ADI formed couplers have carbon equivalency (CE) range of from about 4.3 to about 4.73, and more preferably, has a CE range of from about 4.3 to 4.6. Since alloying elements other than carbon are used in the preferred embodiments, the carbon equivalency provides a value taking into account a conversion of the percentage of alloying elements other than carbon to the equivalent carbon percentage. Iron-carbon phases are better understood than other iron-alloy phases, so the carbon equivalency (CE) is used. A convenient method to accomplish this is to combine the elements of the chemical composition into a single number, equaling the carbon equivalent. There are a number of formulas for ascertaining carbon equivalency. Generally, three primary carbon equivalent formulae have been commonly used in prediction algorithms for hydrogen-assisted cracking of steels. These include: Pcm, CEIIW and CEN. According to preferred embodiments, preferred CE values for ADI used to construct the couplers are determined by: CE=% C+⅓ (% Si). According to preferred embodiments, the iron is alloyed with additional components, including those set forth in the formulas below. Preferred embodiments of the couplers are constructed from ADI that has an alloy content that is greater than 4.0%. Further preferred embodiments of the couplers are constructed from ADI having alloy content greater than 4.0% and a carbon equivalency value of 4.37 to 4.73.

According to some preferred embodiments, ADI couplers are made in accordance with the following composition:

| | |
|---|---|
| Carbon Equivalent | 4.37-4.73 |
| Carbon | 3.60-3.80% |
| Silicon | <2.60%; |
| Copper | 0.50-0.70% |
| Manganese | 0.35-0.45% |
| Nickel | <0.03% |
| Chromium | <0.05% |
| Magnesium | 0.030-0.050% |
| Iron | balance of the composition. |

In one proposed example, the above composition is cast in a mold to form a coupler. Cores, such as sand cores, may be used to define cavities that will be formed in the completed respective coupler. The molten metal may be introduced into the mold cavity or cavities through one or more gates. When the molten metal has filled the mold cavities, and it is allowed to solidify. The coupler casting is removed from the mold, and cores are removed from the respective casting, or broken apart if required for their removal. The coupler casting is austempered through a series of heating and cooling steps. The cast iron is raised to a heating temperature above the $Ae_3$ temperature, or above 910 degrees C. (*Modern Physical Metallurgy*, R. E. Smallman, A. H. W. Ngan, Chapter 12, Steel Transformations, p. 474, FIG. 12.1) After heating to above about 910 degrees C., the respective coupler casting is then rapidly quenched and held at the lower temperature. According to this proposed example, the resultant coupler formed from the composition and ADI, is a 190/160/7 ADI.

According to preferred embodiments, walls forming the coupler have carbon equivalent (CE) in a prescribed range. One way in which the carbon equivalent (CE) value is expressed, is CE=% C+⅓ (% Si). According to preferred embodiments, the CE range is about 4.3 to about 4.6. According to preferred embodiments, where the wall thickness is between about 0.25" to 2", the coupler wall has a CE range of from about 4.3 to about 4.6, and where the wall is over 2", then the CE range is between about 4.3 to 4.5. In addition, preferred embodiments of the ADI couplers are constructed from casting that has minimum nodularity properties. According to preferred embodiments, the ADI coupler castings have a minimum nodule count of 100/mm2 and minimum nodularity of 90%.

According to another preferred formulation, the ADI casting is made from a composition as follows:

| Elements | Percentage | Preferred Control Range |
|---|---|---|
| C Carbon | 3.6% | +/−0.20% |
| Si Silicon | 2.5% | +/−0.20% |
| Mg Magnesium | (% S × 0.76) + 0.025% | +/−0.005% |
| Mn Manganese | | |
| Max. section > ½" | 0.35% maximum | +/−0.05% |
| Max. section < ½" | 0.60% maximum | +/−0.05% |
| Cu Cooper | 0.80% maximum (only as needed) | +/−0.05% |
| Ni Nickel | 2.00% max. (only as needed) | +/−0.10% |
| Mo Molybdenum | 0.30% max. (only as needed) | +/−0.03% |
| Sn Tin | 0.02% max. (only as needed) | +/−0.003% |
| Sb Antimony | 0.002% max. (only as needed) | +/−0.0003% |
| P Phosphorus | 0.02% maximum | |
| S Sulfur | 0.02% maximum | |
| O Oxygen | 50 ppm maximum | |
| Cr Chromium | 0.10% maximum | |
| Ti Titanium | 0.040% maximum | |
| V Vanadium | 0.10% maximum | |
| Al Aluminum | 0.050% maximum | |
| As Arsenic | 0.020% maximum | |
| Bi Bismuth | 0.002% maximum | |
| B Boron | 0.0004% maximum | |
| Cd Cadmium | 0.005% maximum | |
| Pb Lead | 0.002% maximum | |
| Se Selenium | 0.030% maximum | |
| Te Tellurium | 0.003% maximum | |
| Iron | Balance of formula | |

Iron being the balance of the composition, which may range from about 89 to about 95%.

According to preferred embodiments, the couplers include at least some walls whose thicknesses are greater than 0.75 inches, and according to some other embodiments at least some walls are greater than 0.5 inches. Some preferred embodiments are constructed from ADI of the above formulas, wherein hardening alloys are added to the ductile iron forming the casting so as to reduce pearlite formation during the austempering quenching step. Preferred hardening alloys include alloying elements, such as Mo, Cu and Ni. The hardening alloys may be added, preferably, in amounts less than or up to the maximum respective amount. For example, in the first listed formula set forth above, the hardening alloys may be added to the formula up to the maximum amounts specified in the second listed formula (above).

According to preferred embodiments, the ADI couplers may be formed with an ADI alloy that contains nodulizing elements. One example of a preferred embodiment includes Mg as a nodulizing element. In addition, according to alternate embodiments, other examples of nodulizing elements include beryllium, calcium, strontium, barium, yttrium, lanthanum and cerium. Although Mg is used in preferred embodiments, in other embodiments an alternative nodulizing element or combination of elements may be used. According to preferred embodiments, the amount of residual Mg plus the amounts of other nodulizing elements (e.g., beryllium, calcium, strontium, barium, yttrium, lanthanum and cerium) is less than or up to about 0.06%. According to some preferred embodiments, Ce may be used as an alloy to facilitate nodulization. According to some preferred embodiments, the ADI couplers are produced by forming a ductile iron casting, and subjecting the casting to an austempering process of elevated temperatures and quenching. The ADI couplers according to the invention are produced to have high nodularity and nodule formation throughout the solidification of the ADI coupler castings, which is preferably done using an inoculant. According to preferred embodiments, a mixture of La, Ca, S and O is provided in the inoculant. The inoculant may be referred to as a post inoculant, as the ductile iron may be alloyed with one or more alloy elements, and, the inoculant may be a separate addition, added to the molten ductile iron/alloy or mold to which the molten ductile iron/alloy is being added. The coupler of the invention preferably is produced using ductile iron, to which small amounts of other elements have been added, as discussed herein, and to include in the addition thereto, preferably, at the molten stage of the ductile iron/alloy, an inoculant. The inoculant preferably is an element or combinations of elements that increase nodule formation. According to a preferred embodiment, the inoculant is selected from the group consisting of La, Ca, S and O (and mixture thereof). The inoculant may be added to the stream of molten metal (the molten ductile iron and alloy components) as it is poured into the mold. Alternatively, the inoculant is added to ductile iron by adding the inoculant in the mold. Preferred embodiments of the ADI couplers are produced from inoculated ductile iron (by an addition of the inoculant to the molten material as it is being admitted to the mold, or introducing the inoculant to the mold into which the molten ductile iron is to be admitted). The inoculated ductile iron casting is then austempered. The increased nodule formation and high nodularity throughout the improved couplers provides improvements in strength, particularly an increase resistance to fatigue and cracking.

According to embodiments, the couplers are constructed having a high nodule count, high nodularity, or both. According to some preferred embodiments, the nodularity and nodule count may be optimized. Couplers according to preferred embodiments are constructed having a minimum nodule count, which may be expressed in a number of nodules per unit of area. For example, according to some preferred embodiments, the ADI couplers are constructed having a nodule count that is at least 90 per mm2, and preferably, at least 100 per mm2. Some preferred embodiments of the ADI couplers are provided having nodularity that is a minimum of 80%, and more preferably, at least 90%. According to some preferred embodiments, couplers are constructed from ADI and have, both a nodule count that is at least 90 per mm2, and preferably, at least 100 per mm2, and also have nodularity that is a minimum of 80%, and more preferably, at least 90%.

According to preferred embodiments, the wall thicknesses of the couplers may be constructed to be lighter, yet at the same time, impart suitable strength characteristics. The invention further provides embodiments of couplers with improved constructions having walls that have thicknesses that allow for improved configurations. According to some embodiments, couplers may be formed from ADI in accordance with the ADI compositions and methods disclosed herein, and, in addition, the ADI couplers may be constructed with walls having wall thicknesses as disclosed herein, including within ranges, or in accordance with maximums and/or minimums disclosed.

It is intended that the foregoing detailed description be regarded as illustrative rather than limiting, and that it be understood that it is the following claims, including all equivalents, that are intended to define the spirit and scope of this invention. Numerous other changes, substitutions, variations, alterations and modifications may be ascertained by those skilled in the art and it is intended that the present invention encompass all such changes, substitutions, variations, alterations and modifications as falling within the spirit and scope of the appended claims.

What is claimed is:

1. A railway vehicle coupler comprising:

(a) a shank portion;

(b) a coupler head portion extending from said shank portion, (c) the coupler head portion configured to couple to a first coupler knuckle for coupling the railcar coupler to a second railcar coupler of an adjacent railcar;

(d) the coupler head portion comprising a nose portion and a gathering face extending from the nose portion for engaging a second coupler knuckle coupled to the second railcar coupler;

(e) the coupler head portion comprising a guard arm portion extending from the nose portion towards the shank portion;

(f) wherein said coupler is made from austempered ductile iron, wherein said austempered ductile iron includes a post inoculant containing a mixture of La, Ca, S and O;

(g) wherein said nodularity is at least 90%, and wherein said coupler has a Brinell hardness of about 302 to 460;

(h) wherein the minimum tensile strength is 130 ksi;

(i) wherein the minimum yield strength is 90 ksi; and (j) wherein the minimum elongation in 2 inches is 2%.

2. The coupler of claim 1, wherein said coupler is constructed from austempered ductile iron having a composition according to the following formula:

| Elements | Percentage | Range |
|---|---|---|
| C Carbon | 3.6% | +/−0.20% |
| Si Silicon | 2.5% | +/−0.20% |
| Mg Magnesium | (% S × 0.76) + 0.025% | +/−0.005% |
| Mn Manganese | | |
| Max. section > ½" | 0.35% maximum | +/−0.05% |
| Max. section < ½" | 0.60% maximum | +/−0.05% |
| Cu Cooper | 0.80% maximum | +/−0.05% |
| Ni Nickel | 2.00% maximum | +/−0.10% |
| Mo Molybdenum | 0.30% maximum | +/−0.03% |
| Sn Tin | 0.02% maximum | +/−0.003% |
| Sb Antimony | 0.002% maximum | +/−0.0003% |
| P Phosphorus | 0.02% maximum | |
| S Sulfur | 0.02% maximum | |
| O Oxygen | 50 ppm maximum | |
| Cr Chromium | 0.10% maximum | |
| Ti Titanium | 0.040% maximum | |
| V Vanadium | 0.10% maximum | |
| Al Aluminum | 0.050% maximum | |
| As Arsenic | 0.020% maximum | |
| Bi Bismuth | 0.002% maximum | |
| B Boron | 0.0004% maximum | |
| Cd Cadmium | 0.005% maximum | |
| Pb Lead | 0.002% maximum | |
| Se Selenium | 0.030% maximum | |
| Te Tellurium | 0.003% maximum | |
| Iron | Balance of formula. | |

3. The coupler of claim 2, wherein said austempered ductile iron has an alloy content that is greater than 4.0%.

4. The coupler of claim 3, wherein said austempered ductile iron has a carbon equivalent (CE) value of 4.3 to 4.6.

5. The coupler of claim 2, wherein said coupler is defined by a plurality of walls including a nose wall, a first guard arm wall defining a gathering face, a second guard arm wall defining a guard arm side of the coupler, and shank walls defining the coupler shank; wherein each of said plurality of walls has wall thicknesses between 0.25"-2.5".

6. The coupler of claim 5, wherein said plurality of walls have well thicknesses between 0.375" to 1.75".

7. The coupler of claim 5, wherein at least one wall of said plurality of walls has a maximum thickness of 0.25".

8. The coupler of claim 6, wherein at least one wall of said plurality of walls has a maximum thickness of 0.375".

9. The coupler of claim 2, wherein said coupler has a plurality of walls including a nose wall, a first guard arm wall defining a gathering face, a second guard arm wall defining a guard arm side of the coupler, and shank walls defining the coupler shank; wherein each of said plurality of walls has a maximum thickness of 2.5".

10. The coupler of claim 9, wherein each of said walls has a maximum thickness of 1.75".

11. The coupler of claim 5, wherein each of said walls has a maximum thickness of 1.75".

12. The coupler of claim 1, wherein said austempered ductile iron comprises molten ductile iron and alloys in accordance with said formula, wherein said post inoculant is introduced to said molten ductile alloy and alloys, and wherein said coupler is a casting of austempered inoculated ductile iron.

13. The coupler of claim 12, wherein said coupler has a minimum nodule count of 100 per mm2.

14. The coupler of claim 1, wherein said coupler has a minimum nodule count of 100 per mm2.

15. The coupler of claim 13, wherein said coupler has a plurality of walls including a nose wall, a first guard arm wall defining a gathering face, a second guard arm wall defining a guard arm side of the coupler, and shank walls defining the coupler shank; wherein each of said plurality of walls has a wall thicknesses between 0.25"-2.5".

16. The coupler of claim 15, wherein each of said plurality of wells has a wall thickness between 0.375" to 1.75".

17. The coupler of claim 15, wherein at least one of said walls has a maximum thickness of 0.25".

18. The coupler of claim 16, wherein at least one of said walls has a maximum thickness of 0.375".

19. The coupler of claim 13, wherein said coupler has a plurality of walls including a nose wall, a first guard arm wall defining a gathering face, a second guard arm wall defining a guard arm side of the coupler, and shank walls defining the coupler shank; wherein each of said plurality of walls has a maximum thickness of 2.5".

20. The coupler of claim 19 wherein said walls have a maximum thickness of 1.75".

21. The coupler of claim 17, wherein said walls have a maximum thickness of 1.75".

22. The coupler of claim 1, wherein said austempered ductile iron has a carbon equivalent (CE) value of 4.37 to 4.73; and wherein said coupler is constructed from austempered ductile iron having a composition according to the following formula:

| | |
|---|---|
| Carbon | 3.60-3.80% |
| Silicon | <2.60%; |
| Copper | 0.50-70% |

-continued

| | |
|---|---|
| Manganese | 0.35-0.45% |
| Nickel | <0.03% |
| Chromium | <0.05% |
| Magnesium | 0.030-0.050% |
| Iron | balance of the composition. |

23. A railway vehicle coupler comprising:

(a) a shank portion;

(b) a coupler head portion extending from said shank portion, (c) the coupler head portion configured to couple to a first coupler knuckle for coupling the railcar coupler to a second railcar coupler of an adjacent railcar;

(d) the coupler head portion comprising a nose portion and a gathering face extending from the nose portion for engaging a second coupler knuckle coupled to the second railcar coupler;

(e) the coupler head portion comprising a guard arm portion extending from the nose portion towards the shank portion;

(f) wherein said coupler is made from austempered ductile iron, wherein said austempered ductile iron includes a post inoculant containing a mixture of La, Ca, S and O;

(g) wherein said nodularity is at least 90%, and wherein said coupler has a Brinell hardness of about 302 to 460;

(h) wherein the minimum tensile strength is 130 ksi;

(i) wherein the minimum yield strength is 90 ksi; and (j) wherein the minimum elongation in 2 inches is 7%.

24. The coupler of claim 23, wherein said coupler is constructed from austempered ductile iron having a composition according to the following formula:

| Elements | Percentage | Range |
|---|---|---|
| C Carbon | 3.6% | +/−0.20% |
| Si Silicon | 2.5% | +/−0.20% |
| Mg Magnesium | (%S × 0.76) + 0.025% | +/−0.005% |
| Mn Manganese | | |
| Max. section > ½" | 0.35% maximum | +/−0.05% |
| Max. section < ½" | 0.60% maximum | +/−0.05% |
| Cu Cooper | 0.80% maximum | +/−0.05% |
| Ni Nickel | 2.00% maximum | +/−0.10% |
| Mo Molybdenum | 0.30% maximum | +/−0.03% |
| Sn Tin | 0.02% maximum | +/−0.003% |
| Sb Antimony | 0.002% maximum | +/−0.0003% |
| P Phosphorus | 0.02% maximum | |
| S Sulfur | 0.02% maximum | |
| O Oxygen | 50 ppm maximum | |
| Cr Chromium | 0.10% maximum | |
| Ti Titanium | 0.040% maximum | |
| V Vanadium | 0.10% maximum | |
| Al Aluminum | 0.050% maximum | |
| As Arsenic | 0.020% maximum | |
| Bi Bismuth | 0.002% maximum | |
| B Boron | 0.0004% maximum | |
| Cd Cadmium | 0.005% maximum | |
| Pb Lead | 0.002% maximum | |
| Se Selenium | 0.030% maximum | |
| Te Tellurium | 0.003% maximum | |
| Iron | Balance of formula. | |

25. The coupler of claim 23, wherein said coupler is constructed from austempered ductile iron having a composition according to the following formula:

| | |
|---|---|
| Carbon | 3.60-3.80% |
| Silicon | <2.60%; |

-continued

| | |
|---|---|
| Copper | 0.50-0.70% |
| Manganese | 0.35-0.45% |
| Nickel | <0.03% |
| Chromium | <0.05% |
| Magnesium | 0.030-0.050% |
| Iron | balance of the composition. |

* * * * *